United States Patent [19]

Zifferer

[11] Patent Number: 4,846,148

[45] Date of Patent: Jul. 11, 1989

[54] HEATING APPARATUS AND METHOD

[75] Inventor: Lothar R. Zifferer, Waco, Tex.

[73] Assignee: Packless Metal Hose, Inc., Waco, Tex.

[21] Appl. No.: 191,997

[22] Filed: May 9, 1988

[51] Int. Cl.[4] ..... F24H 1/10

[52] U.S. Cl. ..... 126/355; 126/351; 126/350 R; 122/5.5 A

[58] Field of Search ..... 126/360 A, 351, 350 R, 126/359, 355, 350 B, 366; 122/5.5 A; 138/38

[56] References Cited

U.S. PATENT DOCUMENTS

| | | | |
|---|---|---|---|
| 2,200,580 | 5/1940 | Pruss et al. | 261/98 X |
| 2,949,934 | 8/1960 | Schrenk | 138/38 |
| 3,407,805 | 10/1968 | Bougard | 126/360 A |
| 3,533,396 | 10/1970 | Ballard | 126/359 |
| 3,955,932 | 5/1976 | Meyer | 261/98 X |
| 4,354,481 | 10/1982 | Welden | 126/359 X |
| 4,418,651 | 12/1983 | Wyatt | 126/360 A |
| 4,596,235 | 6/1986 | Bougard | 126/355 X |
| 4,627,416 | 12/1986 | Ito et al. | 126/351 |
| 4,685,444 | 8/1987 | Durrenberger | 126/360 A |
| 4,686,940 | 8/1987 | Fullermann | 122/5.5 A X |

*Primary Examiner*—Albert J. Makay
*Assistant Examiner*—Carl D. Price
*Attorney, Agent, or Firm*—Neal J. Mosely

[57] ABSTRACT

An apparatus for heating a liquid by mixing combustion products therewith comprises a housing having a liquid reservoir compartment, a mixing chamber above the reservoir having a tortuous fluid flow path, a combustion chamber above the mixing chamber with a gas burner and apparatus for igniting and burning a mixture of air and fuel and an apertured water jacket at the upper end. A pump draws liquid from the reservoir and discharges it through the water jacket on the combustion chamber side wall to cool the burning mixture. The discharged liquid collects at the lower end of the combustion chamber and flows evenly throughout the tortuous fluid flow path (Raschig rings) in the mixing chamber to thoroughly mix hot combustion gases with the hot liquid mixture for maximum heat transfer. The mixture falls through an air space into the reservoir to separate the excess gases for venting to atmosphere. The heated liquid may be circulated through a hot water supply piping system for industrial usage. A coil submerged in the reservoir allows a second liquid to be heated thereby for use in a hot water supply system for residential or industrial usage. A second coil installed in the combustion chamber and coupled to the lower coil allows higher temperatures to be achieved.

21 Claims, 4 Drawing Sheets

HEATING APPARATUS AND METHOD

BACKGROUND OF THE INVENTION

1. Field of the Invention

This invention relates generally to heating apparatus, and more particularly to a method and apparatus utilizing submerged products of combustion for heating liquids.

2. Brief Description of the Prior Art

Northcott, U.S. Pat. No. 2,900,975 discloses a submerged heating apparatus in which a substantial portion of the combustion zone extends below the liquid level of the material to be heated and wherein the entire burner mechanism and combustion zones are situated within the container holding the liquid to be heated.

Ohara et al, U.S. Pat. No. 3,882,844 discloses a submerged hot gas heat exchanger having a combustion gas sparge pipe with delivery ports along its upper surface, vertical fins connected to the outer surface of each heat exchanger tube, and a process liquid inlet header tank provided as a double tube structure. Baffle plates are provided in each of the tubes in the process liquid evaporating zone.

Luring et al, U.S. Pat. No. 3,060,921 discloses water heater employing the concept of submerged combustion wherein gaseous products of combustion are discharged below the surface of a primary body of water transferring heat by direct mixing. The water which is to be heated and used is circulated through the primary water in indirect thermal contact therewith to be heated by the primary water.

Brock, U.S. Pat. No. 3,568,658 discloses a water heater comprising a tank, a burner can in the tank, water inlet means at the upper portion of the burner can for flowing water thereinto, gas injection means communicating with the upper portion of the burner can for introducing a fuel/air mixture to the burner can, and fluid extraction means communicating with the lower portion of the burner can for evacuating gases and water therefrom. The gases and water extracted from the burner can are injected back into the water of the tank, and the gases bubble up through the water.

Wyatt, U.S. Pat. No. 4,441,460 discloses a method and apparatus for heating fluids by the use of vapor generators in which a fuel/air mixture is burned in the presence of a stream of feed water to produce a stream of steam and non-condensibles which is then heat exchanged with stream of fluid to be heated.

Goodnight et al, U.S. Pat. No. 4,237,858 discloses a gas burner system having a first air supply plenum which is spaced above a second plenum or combustion chamber. A burner is positioned at the inlet to the combustion chamber. Water surrounds the combustion chamber plenum and the side walls around the burner which is used for heating and evaporation.

Santoleri et al, U.S. Pat. No. 3,368,548 discloses a submerged hot gas heat exchanger which includes a tank containing a heat transfer liquid, a plurality of burners surrounded by a shroud depending downwardly into the tank, a weir surrounding the shroud to direct hot gas from the burner outwardly at the bottom of the tank into the liquid, and a plurality of tubes within the tank through which the liquid to be heated an converted into a gaseous state is caused to pass.

Durrenberger, U.S. Pat. No. 4,685,444 discloses a process and equipment for heating a liquid comprising a tank partially filled with water containing an absorbent mixed therein and a tube coil submerged in the water in the tank through which the water to be heated and utilized is conduct ed. A burner is contained in a cylindrical flame tube which extends downwardly into the tank an into the water. Surface area enlarging parts such as Raschig rings may be incorporated into the flame tube between the burner and lower portion of the tube. A rotor is positioned within the lower portion of the flame tube and connected to a motor. The burner produces a flame inside the flame tube and suction is created by the rotor and the combustion gases are drawn into the water in the form of bubbles. The flame gases are precooled by conducting the absorbent liquid from the area in the vicinity of the rotor to the top portion of the flame tube s that the absorbent liquid continuously wets and cools the outer wall of the tube. As the rotor turns, the liquid in the tank rises to enter bores in the flame tube side wall and wets the Raschig rings whereby additional cooling is achieved.

The present invention is distinguished over the prior art in general, and these patents in particular by apparatus for heating a liquid by mixing combustion products therewith. The apparatus comprises a housing having a liquid-containing reservoir compartment, a mixing chamber above the reservoir which contains a tortuous fluid flow path, a combustion chamber above the mixing chamber containing a gas burner and including means for igniting and burning a mixture of air and fuel therein and an apertured water jacket at the upper end thereof. A pump draws liquid from the reservoir and discharges it through the water jacket onto the combustion chamber side wall to cool the burning mixture. The discharged liquid is collected at the lower end of the combustion chamber and distributed evenly throughout the tortuous fluid flow path in said mixing chamber to thoroughly mix the hot combustion gases with the hot liquid mixture for maximum heat transfer. After mixing, the mixture falls through an air space back into the reservoir to separate the excess gases from the mixture which are vented to atmosphere. The heated liquid may be recycled through a hot water supply piping system for industrial usage. A coil submerged in the reservoir allows a second liquid to be heated thereby for use in a hot water supply system for residential or industrial usage. A second coil installed in the combustion chamber and coupled to the lower coil allows higher temperatures to be achieved.

SUMMARY OF THE INVENTION

It is therefore a primary object of the present invention to provide a method and apparatus for heating liquids to provide hot water for domestic or industrial use.

It is another object of this invention to provide a method and apparatus for heating liquids by efficiently mixing products of combustion into the liquid.

Another object of this invention to provide a method and apparatus for heating liquids by mixing products of combustion into a first liquid and circulating a second liquid therethrough in isolated relation.

Another object of this invention to provide a method and apparatus for heating liquids by conducting a liquid through a tortuous path to more efficiently mix products of combustion into the liquid.

A further object of this invention o provide a method and apparatus for heating liquids by efficiently mixing products of combustion into the liquid which is simple in construction, economical to manufacture, and rugged and durable in use.

Other objects of the invention will become apparent from time to time throughout the specification and claims as hereinafter related.

The above noted objects and other objects of the invention are accomplished by an apparatus for heating a liquid by mixing combustion products therewith. The apparatus comprises a housing having a liquid-containing reservoir compartment, a mixing chamber above the reservoir which contains a tortuous fluid flow path, a combustion chamber above the mixing chamber containing a gas burner and including means for igniting and burning a mixture of air and fuel therein and an apertured water jacket at the upper end thereof. A pump draws liquid from the reservoir and discharges it through the water jacket onto the combustion chamber side wall to cool the burning mixture. The discharged liquid is collected at the lower end of the combustion chamber and distributed evenly throughout the tortuous fluid flow path in said mixing chamber to thoroughly mix the hot combustion gases with the hot liquid mixture for maximum heat transfer. After mixing, the mixture falls through an air space back into the reservoir to separate the excess gases from the mixture which are vented to atmosphere. The heated liquid may be recycled through a hot water supply piping system for industrial usage. A coil submerged in the reservoir allows a second liquid to be heated thereby for use in a hot water supply system for residential or industrial usage. A second coil installed in the combustion chamber and coupled to the lower coil allows higher temperatures to be achieved.

DESCRIPTION OF THE PREFERRED EMBODIMENT

Figure 1:
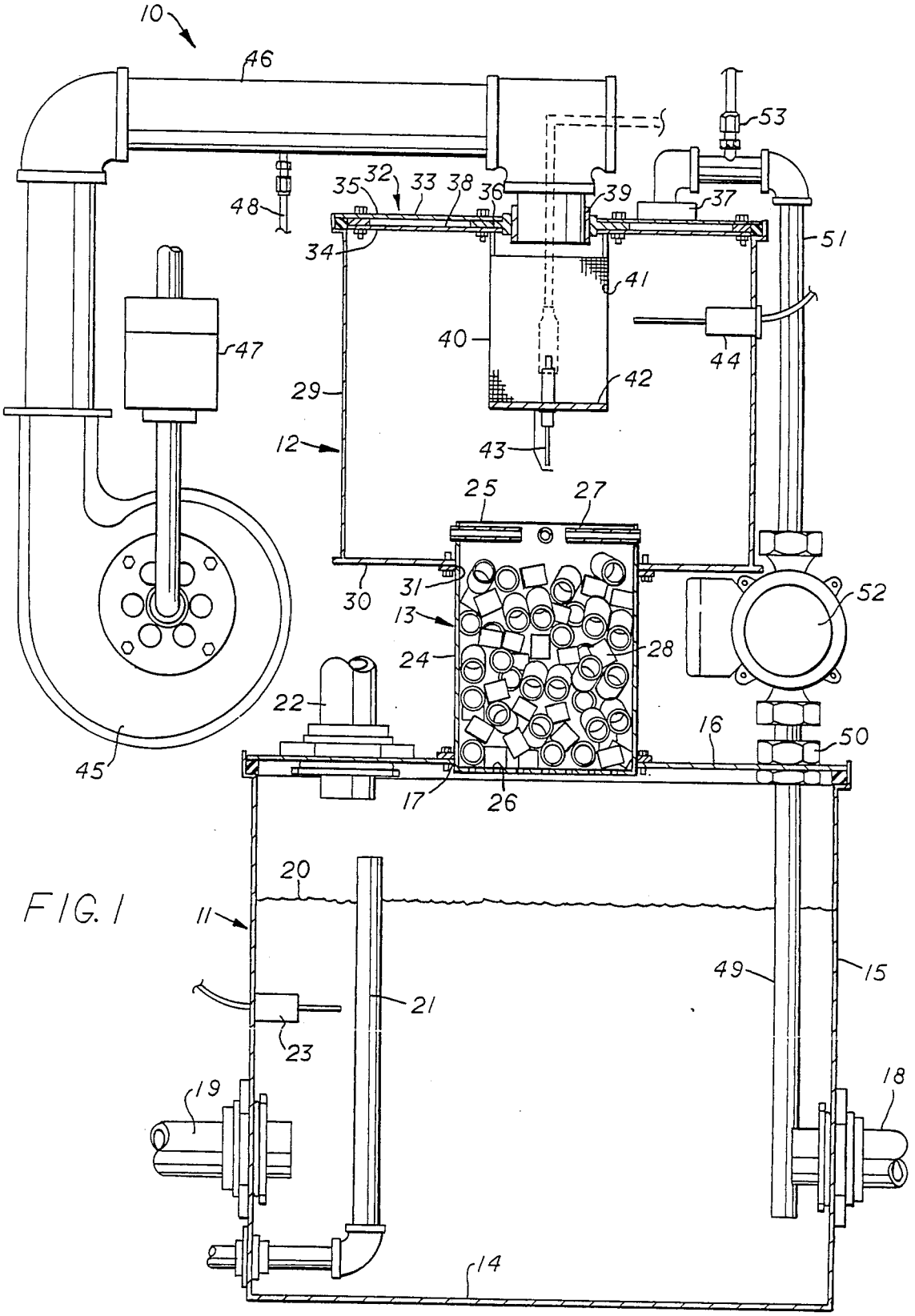
FIG. 1 is a front elevation view in cross section of one embodiment of the heater apparatus in accordance with the present invention.

Referring to the drawings by numerals of reference, there is shown in FIG. 1 one embodiment of a preferred heater apparatus 10. Heater 10 comprises a cylindrical lower compartment or reservoir 11, a cylindrical upper combustion chamber 12, and an intermediate cylindrical mixing chamber 13 disposed therebetween. Members 11, 12, and 13 may also be constructed in a rectangular or square configuration, and may or may not be thermally insulated.

Reservoir compartment 11 has a bottom wall 14, side wall 15, and a top wall 16. Top wall 16 has a central opening 17 into reservoir compartment 11. Nipples or other suitable connections through the side wall 15 provide an inlet 18 and outlet 19 for connecting the reservoir compartment 11 into various heating systems.

Reservoir compartment 11 is substantially filled with a suitable liquid 20, such as water, which may be used to supply hot water for various applications, but is not particularly suited for domestic use, such as for drinking, shower or washing purposes.

Overflow drain tube 21, connected at its lower end to a drain (not shown), extends upwardly inside reservoir compartment 11 to a point above the surface of the reservoir liquid to control the water level and prevent accumulation of water and combustion products condensing in the reservoir. A vent tube 22 extends through top wall 16 and its lower end terminates above the water surface just below the top wall allowing hot air and gases to escape from the reservoir. A temperature control switch 23 may also be located beneath the surface of the liquid in the reservoir 11.

Mixing chamber 13 is secured to the reservoir top wall 16 with its lower end within the opening 17. Mixing chamber 13 comprises a cylindrical side wall 24 having an open top end 25 and enclosed at its lower end by an apertured bottom wall 26. A plurality of circumferentially spaced hollow tubes 27 extend radially inward through the side wall 24 just below the open top end 25.

The mixing chamber 13 is filled with a plurality of Raschig rings 28. The Raschig rings 28 are a type of packing in the shape of short pipes (usually of ceramic) which are normally used in absorption and distillation operations. However, in the present application, they are used in a mixing operation. A large number of the rings 28 are randomly stacked in a column and collectively provide a large surface area with a tortuous path for mixing the hot gases with the hot liquid for maximum heat transfer as the gas/liquid mixture is conducted through the stack of rings.

Combustion chamber 12 has a cylindrical side wall 29 with a bottom wall 30 having a central opening 31 and enclosed at the top end by a flat ring-like water jacket 32. Combustion chamber 12 is secured to mixing chamber 13 whereby the open top end 25 and tubular members 27 of the mixing chamber extend a short distance through the opening 31 and are positioned within the combustion chamber a short distance above bottom wall 30.

Water jacket 32 comprises parallel spaced upper circular plate 33 and lower circular plate 34 circumferentially enclosed by an outer flat circular ring 35 and centrally closed by a center flat circular ring 36. Enclosed plates 33 and 34 form a flat annulus. A collar or other suitable connection through upper plate 33 spaced laterally from the center ring 36 provides an inlet 37 for receiving water from reservoir 11 and apertures 38 through lower water jacket plate 34 direct the water onto the interior of side wall 29 of combustion chamber 12. A collar or other suitable connection through center flat ring 36 provides an inlet 39 for receiving a gas/air mixture.

A cylindrical gas burner 40 is secured concentrically within combustion chamber 12 beneath inlet 39 through ring 36 to extend downwardly into the combustion chamber. Gas burner 40 comprises an apertured cylindrical side wall 41 having a bottom wall 42. A gas igniter 43 is secured through bottom wall 42. A temperature control switch or flame sensor 44 is installed in combustion chamber side wall 29 with the sensor element extending into the combustion chamber. Electrical leads connect flame sensor 44 and igniter 43 to an electrical control box (not shown) containing electrical circuitry and the ignition control unit for the system.

A blower 45 is connected to combustion chamber 12 by piping 46 leading to inlet 39 above gas burner 40. A gas/air valve 47 is operatively connected to blower unit 45 to supply and maintain a predetermined air/gas mixture to the blower unit. An air flow sensor 48 is installed in piping 46 between blower unit 45 and inlet 39.

A tube or pipe 49 extends into reservoir 11 from a suitable pipe connection 50 through top wall 16 and terminates a short distance above reservoir bottom wall 14. Pipe 49 is connected to water jacket inlet 37 at the top of combustion chamber 12 by piping 51. A water pump 52 is installed in piping 51 between pipe 49 and inlet 37 for pumping water from the reservoir into water jacket 32. A water pressure sensor 53 is installed in piping 51 between pump 52 and water jacket inlet 37.

Water is pumped from reservoir 11 into water jacket 32 and is discharged through apertures 38 causing it to run down the interior side wall 29 of combustion chamber 12 to cool the combustion gases. The water will collect at the bottom of combustion chamber 12, and when the depth is sufficient it will flow over open top end 25 of mixing chamber 13 and down side wall 24. The water will also enter the central portion of the mixing chamber through tubular members 27, to evenly distribute the water and products of combustion (gas/-liquid mixture) through the Raschig rings 28. Raschig rings 28 collectively provide a large irregular surface area which causes the hot gases to mix with the water to obtain maximum gas-to-liquid heat transfer.

After a tortuous flow through the Raschig rings, a frothy mixture of return water and hot combustion gases drains through apertured bottom wall 26 of mixing chamber 13 back into the reservoir liquid. As the mixture drains from mixing chamber 13 and falls to the surface of the reservoir liquid, the gases separate from the mixture and are vented to atmosphere through vent pipe 22.

ANOTHER EMBODIMENT

Figure 2:
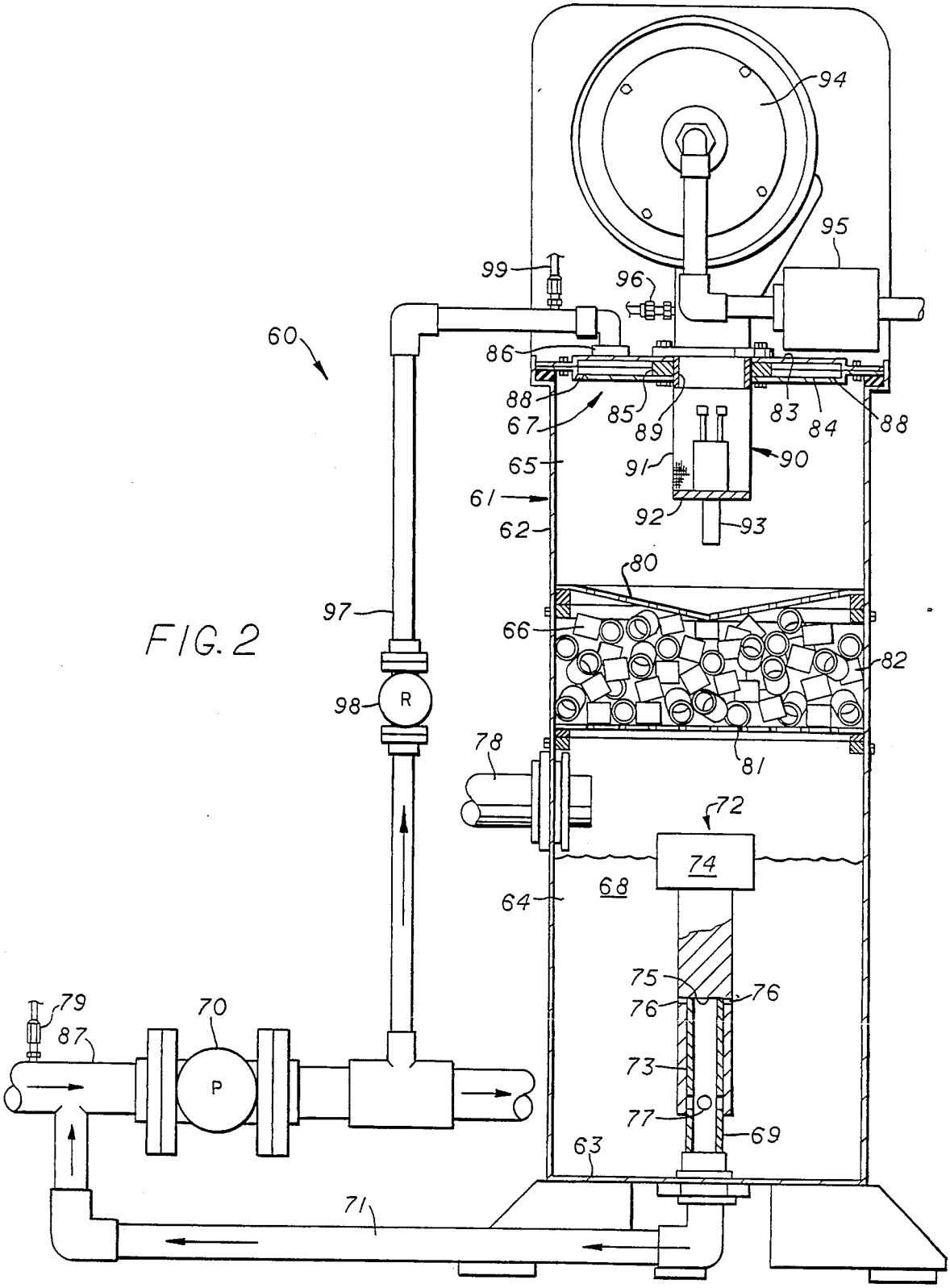
FIG. 2 is a front elevation view in cross section of another embodiment of the heater apparatus in accordance with the present invention.

In FIG. 2 of the drawings, there is shown another embodiment of the heater apparatus 60 in accordance with the present invention. Heater 60 comprises a cylindrical housing 61 having a side wall 62 and a bottom wall 63. Housing 61 is partitioned to form a lower compartment or reservoir 64, an upper combustion chamber 65, and an intermediate cylindrical mixing chamber 66 disposed therebetween. Bottom wall 63 of housing 61 forms the bottom wall of reservoir compartment 64 and the top wall of housing 61 comprises a flat circular ring-like water jacket 67 at the top of combustion chamber 65. The components just described could also be constructed in rectangular or square configuration, and may or may not be thermally insulated.

Reservoir compartment 64 is substantially filled with a suitable liquid 68, such as water, which may be used to supply hot water in various applications, but is not particularly suited for domestic use, such as for drinking, shower or washing purposes. An outlet pipe 69, connected at its lower end to a pump 70 by piping 71 through the bottom wall 63, extends upwardly inside reservoir compartment 64 a distance below the surface of the reservoir liquid.

A generally cylindrical float valve 72 having a central bore 73 slightly larger in diameter than the outlet pipe 69 and an enclosed hollow top portion 74 is slidably received on the open top end of the outlet pipe. Central bore 73 terminates below the hollow portion 74 to form bottom wall 75 of the hollow portion. In the closed position, bottom wall 75 closes off the open top end of outlet pipe 69.

One or more small holes 76 extend radially outward from the top end of bore 73 to the exterior of float valve 72. One or more water discharge holes 77 larger in diameter than the holes 76 extend through the side wall of the outlet pipe 69. Water discharge holes 77 are located on pipe 69 at the location of the bottom of float valve 72 such that they will be closed thereby when the float valve is in the closed position.

A vent tube 78 extends through housing side wall 62 above the water surface just below the bottom of the mixing chamber for allowing air and gases to escape from the reservoir. A temperature control switch sensor 79 is installed in the return line 87 from the device being heated.

It can be seen from the foregoing description, that float valve 72 rises and falls with the water level, thus opening or closing the water discharge holes 77. The small holes 76 allow water flow when float valve 72 moves up or down to provide for efficient reciprocal movement on pipe 69. In this manner, the water level may be maintained at a relatively constant level.

Mixing chamber 66 is disposed above reservoir compartment 64 within housing 61. Mixing chamber 66 has an inwardly and downwardly tapered top wall 80 and a bottom wall 81 spaced therebelow. Top and bottom walls 80 and 81 are apertured. Mixing chamber 66 is substantially filled with a plurality of Raschig rings 82. The apertures in tapered top wall 80 are positioned to distribute water evenly across the top portion of the Raschig rings 82.

Combustion chamber 65 is positioned above mixing chamber 66 and is enclosed at the bottom end by tapered top wall 80 of mixing chamber 66 and at the top end by flat annular water jacket 67.

Water jacket 67 comprises a parallel spaced upper circular plate 83 and lower circular plate 84 joined together at their outer circumference and centrally enclosed by a center flat circular ring 85. The enclosed plates 83 and 84 form a flat annular configuration. A collar or other suitable connection through upper plate 83 spaced laterally from center ring 85 provides an inlet 86 for receiving water from reservoir 64 or water return line 87 and apertures 88 through lower water jacket plate 84 direct the water onto the interior of side wall 62 of housing 61. A collar or other suitable connection through center flat ring 85 provides a inlet 89 for receiving a gas/air mixture.

A cylindrical gas burner 90 is secured concentrically within combustion chamber 65 beneath inlet 89 through ring 85 to extend downwardly into the combustion chamber. Gas burner 90 comprises an apertured cylindrical side wall 91 having a bottom wall 92. A gas igniter/flame sensor 93 is secured through the bottom wall 92. Electrical leads connect the igniter/flame sensor 93 to an electrical control box (not shown) containing electrical circuitry and the ignition control unit for the system.

A blower 94 is connected to combustion chamber inlet 89 above gas burner 90. A gas/air valve 95 is operatively connected to blower unit 94 to supply and maintain a predetermined air/gas mixture to the blower unit. An air flow pressure sensor 96 is installed in the piping between blower unit 84 and inlet 89.

Piping 71 connects outlet pipe 69 into water supply or return line 87 and pump 70 is installed downstream of the connection. Another piping assembly 97 connects water jacket inlet 86 into the water supply or return line downstream of pump 70. A water pressure regulator 98 and water pressure sensor 99 is installed in piping 97 between pump 70 and water jacket inlet 86.

When float valve 72 is in the raised position, water is drawn out through outlet pipe 69 into main water supply line 87 and pumped to the object to be heated. A mixture of the supply water and hot return water from the reservoir is also pumped to water jacket 67 and is discharged through water jacket apertures 88 causing it run down the interior of side wall 62 in combustion chamber 65 to cool the combustion gases.

The heated water will collect at the bottom of combustion chamber 65 on top wall 80 of mixing chamber 66, and as it runs down the tapered surface will drain through the apertured wall to evenly distribute the heated return water and products of combustion (gas/-liquid mixture) through Raschig rings 82. The Raschig rings 82 collectively provide a large irregular surface area which aids in mixing the hot gases with the water as the gas/liquid mixture passes thereover to obtain maximum gas-liquid heat transfer.

After a tortuous flow through the Raschig rings, a frothy mixture of return water and hot combustion gases drain through apertured bottom wall 81 of mixing chamber 66 back into the reservoir liquid. As the mixture drains from mixing chamber 66 and falls to the surface of the reservoir liquid, the gases separate from the mixture and are vented to atmosphere through vent pipe 78.

ANOTHER EMBODIMENT

Figure 3:
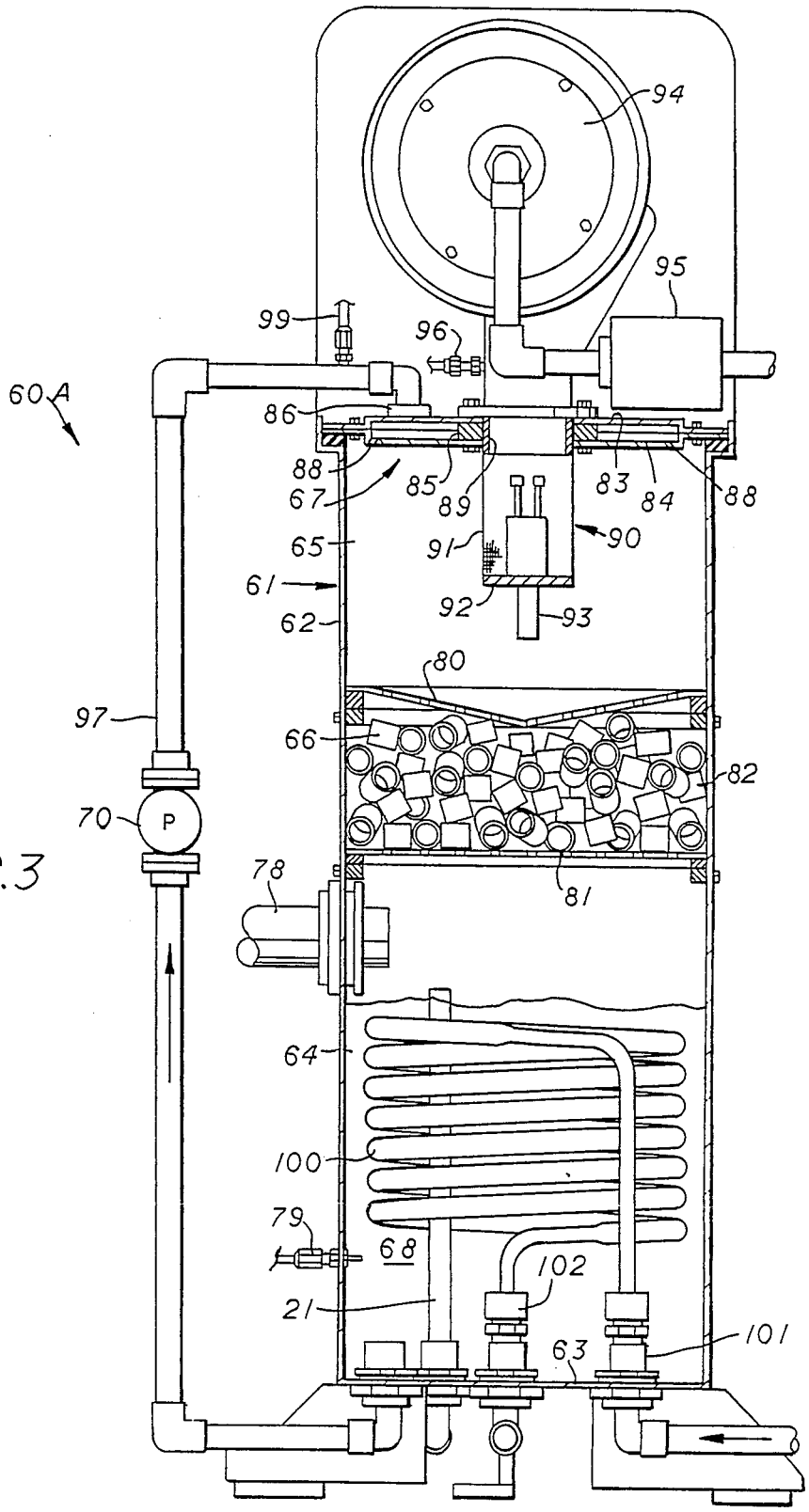
FIG. 3 is a front elevation view in cross section of a modification of the embodiment of the heater apparatus of FIG. 2 having a liquid to liquid coil in the reservoir compartment.

FIG. 3 shows a modification of the heating apparatus 60A. Components of the heating apparatus previously described with reference to FIGS. 1 or 2 are assigned the same numerals of reference but their description will not be repeated to avoid repetition. Overflow drain tube 21, connected at its lower end to a drain (not shown), extends upwardly inside reservoir compartment 64 to a point above the surface of the reservoir liquid to control the water level and prevent accumulation of water and combustion products condensing in the reservoir.

A tubular hot water coil 100 is submerged in reservoir liquid 68. Suitable inlet and outlet connections 101 and 102 in housing bottom wall 63 connect coil 100 into a line carrying water from a source to an object requiring heated water which is suitable for drinking, shower or washing purposes, such as a swimming pool or spa. The coil 100 also allows use of the heater for such applications as an auxiliary heater for a heat pump, an exothermic atmosphere generator, or a preheater for boiler water. In the embodiment of FIG. 3, pump 70 is installed in piping assembly 97 which connects outlet pipe 69 to water jacket inlet 86 and temperature control switch sensor 79 is installed in the reservoir.

ANOTHER EMBODIMENT

Figure 4:
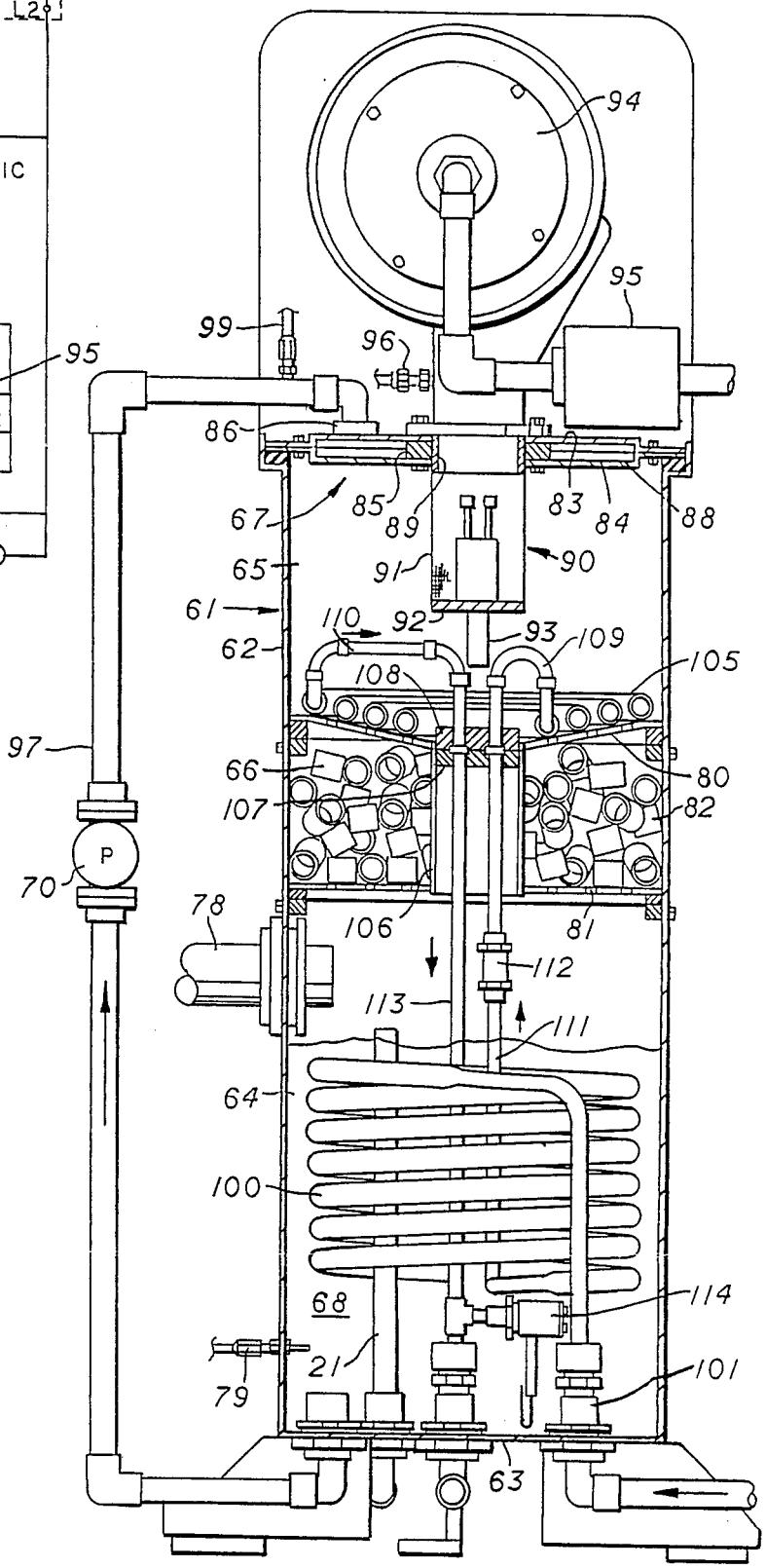
FIG. 4 is a front elevation view in cross section of another modification of the embodiment of the heater apparatus of FIG. 2 having a gas to liquid coil in the combustion chamber and a liquid to liquid coil in the reservoir compartment.

FIG. 4 shows another modification of the heating apparatus 60B which is used for higher temperatures. The embodiment FIG. 4 is substantially similar to the embodiment of FIG. 3 except that higher temperatures may be achieved by passing fluid through the additional gas to liquid coil 105.

Components of the heating apparatus previously described with reference to FIGS. 1, 2, or 3 are assigned the same numerals of reference but their description will not be repeated to avoid repetition.

Overflow drain tube 21, connected at its lower end to a drain (not shown), extends upwardly inside reservoir compartment 64 to a point above the surface of the reservoir liquid to control the water level and prevent accumulation of water and combustion products condensing in the reservoir. Pump 70 is installed in piping assembly 97 which connects outlet pipe 69 to the water jacket inlet 86.

The mixing chamber 66 is modified to have a central hollow cylindrical member 106 extending between the tapered top wall 80 and the bottom wall 81. Top and bottom walls 80 and 81 are apertured as previously described. The portion of mixing chamber 66 surrounding cylindrical member 106 is substantially filled with a plurality of Raschig rings 82. The apertures in the tapered top wall 80 are positioned to distribute water evenly across the top portion of Raschig rings 82.

The top end of cylindrical member 106 is enclosed with a flat cylindrical plate 107 and a mating flange 108 is mounted thereon. A pair laterally spaced holes extend through the plate 107 and flange 108 and receive sections of pipe as described hereinafter.

A spiral "gas to liquid" coil 105 is disposed above top wall 80 of mixing chamber 66. The inlet end and outlet end of coil 105 are connected by sections of pipe 109 and 110 respectively to the holes in the flange 108.

A tubular hot water coil 100 is submerged in reservoir liquid 68. Inlet connection 101 in housing bottom wall 63 connects coil 100 into a line carrying water from a warm water source to an object requiring high temperature water. The outlet end of the coil 100 is connected to section of pipe 111 extending upwardly and secured to a hole in the circular plate 107 in axial alignment with the coil inlet pipe 109. A check valve 112 is installed in the section of pipe 111.

An insulated pipe 113 secured to the other hole in the circular plate 107 in axial alignment with the coil outlet pipe 110 extends downwardly through a connection in the bottom wall 63. A steam pressure relief valve 114 is installed in pipe 113 near its bottom end. Suitable seals in the circular plate and flange connection seal the inlet and outlet pipe connections between pipes 109, 110 and 111, 113

It should be understood that additional types of media can be circulated through the coils of the embodiments of FIGS. 3 and 4, thus allowing use of the heater as a chemical heater. The gas to liquid coil 105 is exposed to the hot gases in the combustion chamber 65 and allows higher temperatures to be achieved.

OPERATION

In operation, the heater is connected in the domestic water supply of the building being served by the heater. As cold water from the supply line flows into reservoir 11 (FIG. 1), or into water jacket inlet 86 (FIG. 2), it becomes heated as explained hereinafter.

Upon receiving a demand signal, the gas valve and blower unit are activated to blow a mixture of air and gas from through the burner within the combustion chamber. The gases are pre-mixed prior to combustion by the gas valve.

Combustion occurs as the gases emerge from the apertured surface of the burner and are ignited by the igniter component. The combustion gases are cooled by the reservoir liquid pumped into the water jacket which is discharged through apertures to run down the interior side wall of the combustion chamber.

In the embodiment of FIG. 1, the mixture of hot liquid, combustion gases, and combustion by-products collect at the bottom of the combustion chamber and when reaching the proper depth, the mixture flows over the open top end and through the tubular members of the mixing chamber. The tubular members direct the hot mixture onto the Raschig rings near the center of the mixing chamber while the mixture flowing over the open top end of the chamber falls on the outer Raschig rings.

In the embodiment of FIG. 2, the mixture of hot liquid, combustion gases, and combustion by-products collect on the top wall of the mixing chamber and as it runs down the tapered surface drains through the apertured wall to evenly distribute the return water and products of combustion (gas/liquid mixture) through the Raschig rings.

In this manner, the mixture of hot liquid, combustion gases, and combustion by-products are substantially evenly distributed onto the upper portions of the Raschig ring stack. The Raschig rings collectively provide a large irregular surface area which aids in mixing the hot gases with the water as the gas/liquid mixture passes thereover to obtain maximum heat transfer.

After a tortuous flow through the Raschig rings, a frothy mixture of return water and hot combustion gases drains through the apertured bottom wall of the mixing chamber back into the reservoir liquid. As the mixture drains from the mixing chamber and falls to the surface of the reservoir liquid, the gases separate from the mixture and are vented to atmosphere through the vent pipe. The liquid level control tube or float valve in the reservoir compartment controls the reservoir liquid level.

The resulting hot reservoir liquid provides hot water for a variety of uses, but is not particularly suited for drinking, swimming or washing. For applications requiring potable hot water suitable for drinking or swimming, the heating unit may be equipped with a coil as shown in FIGS. 3 and 4. As cold water from the inlet flows through the coil, it becomes heated due to the surrounding hot reservoir liquid and may then be conducted to the object requiring heated water such as a shower, swimming pool, or spa.

DETAILED OPERATIONAL SEQUENCE

Figure 5:
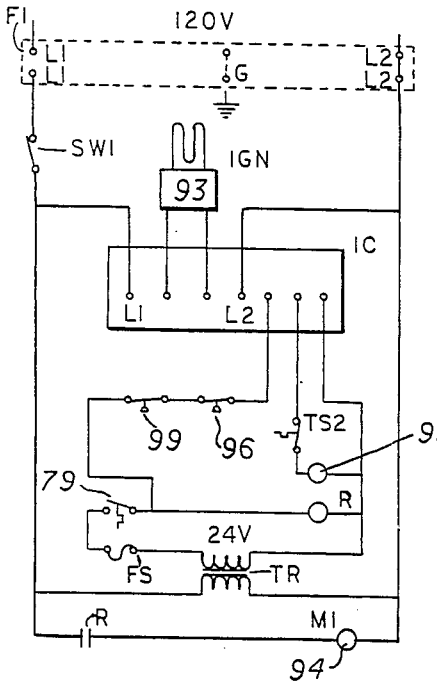
FIG. 5 is an electrical schematic diagram of the control circuitry used in the operation of the heater systems.

Referring additionally to FIG. 5, a detailed sequence of operation with reference to FIGS. 2, 3, and 4 will be described.

The sequence of operation of the embodiment of FIG. 2 is described using the heater to heat water for a swimming pool as an example. Before the heater control system is energized, the existing pool circulator pump must be operative. 120V AC power is required for unit operation through a grounded power block F1. Low voltage system controls are supplied reduced power through a 120/24V transformer TR.

When pool heater on-off switch SWI is turned on, temperature control 79 senses the water temperature in the returning pool water line 87. If the temperature is low, relay R is closed turning on blower motor M1 (94). Water flow to pool heater is sensed by a pressure switch 99. Air pressure switch 96 senses air flow to the burner 90. When water or air flow is detected, pressure switches 99 and 96 close and signal the ignition control IC to turn on the gas burner 90. In the event water or air flow to the heater is not sensed, the respective pressure switch 99 or 96 will de-energize relay R and prevent unit operation.

The ignition control IC dictates the operation of gas valve 95 and igniter/flame sensor 93. After an ignition trial, igniter 93 is de-energized and attempts to sense a flame. In the event that the gas fails to ignite, the ignition control IC will turn off ga valve 95. The sequence will be repeated up to two more times, and if the flame fails again, the ignition control IC will turn off gas valve 95 and go into lockout. The ignition control IC is reset by momentarily switching off the main electrical disconnect switch.

Water pumped through combustion chamber 65 is mixed with hot gases while being drawn through Raschig rings 82 to cool the gases. The gases are drawn into the reservoir 64 thus transferring heat to the water in the reservoir. The pool circulator pump mixes hot water from the reservoir with cooler return water from the swimming pool thus providing heated water for the pool (or other object being heated). In the embodiments of FIGS. 3 and 4, the hot water in the reservoir heats the liquid flowing through the coil 100.

If for any reason water used to cool the gases is not delivered in the required amount to combustion chamber 65, burner 90 is prevented from reaching high temperature by a temperature switch TS2 which senses a preset limit and shuts the burner off.

The burner 90 will continue to operate until the temperature of the water in the reservoir 64 rises above the limit set by temperature switch 79. The switch 79 de-energizes relay R thus turning off the gas valve 95 and blower motor M1 (94). In the embodiments of FIGS. 3 and 4, the relay will also turn off the pump motor M2 (70).

If the pool circulator pump is turned off to backwash the pool filter, then pressure switch 99 de-energizes relay R turning off the heater. When the pool circulator pump is reactivated, the heater will come on automatically.

The purpose of the water regulator 98 is to assure a constant flow of water into the heater irrespective of pressure variations in the line coming from the pool circulator pump and pool filter.

While this invention has been described fully and completely with special emphasis upon several preferred embodiments, it should be understood that within the scope of the appended claims the invention may be practiced otherwise than as specifically described herein.

I claim:

1. A method of heating which comprises;

providing a burner positioned directly over a vertically oriented combustion chamber having an upper end and a lower end and a reservoir containing liquid therein positioned directly under said lower end, igniting and burning a mixture of gaseous or vaporized fuel and air in said combustion chamber, conducting liquid into the upper end of said combustion chamber and down the walls thereof to cool the combustion gases, collecting a hot mixture of liquid and combustion products at the lower end of said combustion chamber, providing a tortuous fluid flow path for said mixture of liquid and combustion products from the bottom of said combustion chamber and terminating a predetermined distance above the surface of said liquid in said reservoir, distributing said collected mixture of hot liquid and combustion products evenly through and across said tortuous fluid flow path and allowing said liquid mixture to drain therethrough to thoroughly mix the hot combustion gases with said hot liquid mixture for maximum heat transfer, collecting said hot liquid in said reservoir by allowing the mixture to fall from said tortuous flow path through said predetermined distance above the surface of liquid collected in said reservoir, and removing gases separated from the mixture falling from said tortuous path into said reservoir liquid.

2. A method according to claim 1 which comprises;

providing a mixing chamber containing said tortuous fluid flow path, and an apertured water jacket at the upper end of said combustion chamber in fluid communication with said reservoir, conducting a portion of said hot liquid from said reservoir through said water jacket and discharging said hot liquid into said combustion chamber to cool the combustion gases.

3. A method of heating according to claim 2 including the step of conducting hot liquid from said reservoir through a hot water supply piping system for remote usage.

4. A method of heating according to claim 2 including the step of controlling the height of the liquid in said reservoir to prevent accumulation of liquid and condensed combustion products above a predetermined level.

5. A method of heating according to claim 2 including the step of passing a second liquid through a conduit in heat exchange relation with hot liquid in said reservoir for heating.

6. A method of heating according to claim 5 including the step of conducting said second liquid after heating through a hot water supply piping system for remote usage.

7. A method of heating according to claim 5 including the step of passing said second liquid through a second conduit in heat exchange relation with hot gases in said combustion chamber after leaving the first said conduit for heating it to a higher temperature than when it leaves the first said conduit, and thereafter conducting said higher temperature liquid through a hot water supply piping system for remote usage.

8. An apparatus for heating a liquid by mixing combustion products therewith comprising;

a liquid reservoir containing liquid at a predetermined level, a mixing chamber directly above said reservoir having a top opening and a bottom opening directly into said reservoir, a vertically oriented combustion chamber directly above said mixing chamber having a closed top end and a bottom opening directly into the top opening of said mixing chamber, a gas burner positioned in said combustion chamber top end and directed downward thereinto and means for igniting and burning a mixture of air and fuel therein, means for conducting a mixture of air and fuel to and through said burner, pump means for conducting liquid from said reservoir into and adjacent said combustion chamber closed top end to cool the combustion gases, means in said mixing chamber for distributing the mixture of liquid and combustion products evenly through a tortuous fluid flow to further mix the mixture for maximum heat transfer therebetween, means for collecting the mixture of liquid and combustion products from said burner in the bottom end of said combustion chamber and distributing said mixture evenly into and across said mixing chamber top opening and across said means for distributing flow through a tortuous fluid flow path, and means located above the level of liquid in said reservoir for removing spent combustion gases separated from said mixture of combustion products and liquid flowing through said tortuous flow path into said reservoir.

9. An apparatus according to claim 8 in which said combustion chamber has an apertured water jacket at the top end, said pump means conducts liquid from said reservoir through said water jacket into said combustion chamber burner to cool the combustion gases, and wherein said means for removing spent combustion gases comprises a vent pipe for venting gases separated from the mixture of gaseous combustion products and liquid falling from said mixture chamber into said reservoir.

10. An apparatus according to claim 9 including means for controlling the height of said liquid in said reservoir to prevent accumulation of liquid and condensed products of combustion above a predetermined level.

11. An apparatus according to claim 9 including means for directing a portion of said reservoir liquid through a hot water supply piping system for usage of said liquid after heating.

12. An apparatus according to claim 9 including conduit means for conducting a second liquid in heat exchange with the hot liquid in said reservoir to heat said second liquid for external use.

13. An apparatus according to claim 12 in which said conduit means passing a second liquid through said reservoir comprises;

a tubular coil within said reservoir submerged in said reservoir liquid for connection to a piping system external of said housing.

14. An apparatus according to claim 9 including conduit means for conducting a second liquid in heat exchange with the hot liquid in said reservoir and with the hot combustion gases in said combustion chamber to heat said second liquid for external use.

15. An apparatus according to claim 14 in which said conduit means passing a second liquid through said reservoir and said combustion chamber comprises;

a tubular coil having a first portion within said reservoir submerged in said reservoir liquid to heat said second liquid, and a second portion within said combustion chamber in fluid communication with the first portion for conducting the heated second liquid in heat exchange with said combustion gases therein and connected to a piping system external of said housing.

16. An apparatus according to claim 9 wherein said mixing chamber tortuous fluid flow path means comprises;

a large irregular surface area disposed beneath the burner over which the liquid runs after being discharged into the combustion chamber while exposed to the burning fuel and air mixture to thoroughly mix the combustion products with the running liquid for maximum heat transfer.

17. An apparatus according to claim 16 in which said large irregular surface area comprises;

a column formed of a plurality of randomly stacked small tubular members.

18. An apparatus according to claim 9 wherein said means for conducting liquid from said reservoir and discharging it close to said burner comprises, a cylindrical combustion chamber above said mixing chamber and surrounding said burner, a hollow generally flat circular ring-like water jacket concentric within the top end of said combustion chamber and having apertures therethrough for directing liquid onto an interior wall of said combustion chamber, said pumping means includes a pump operatively connected between said water jacket and a conduit submerged at one end in said reservoir liquid for conducting liquid through said jacket apertures onto said combustion chamber interior wall to cool the combustion gases.

19. An apparatus according to claim 18 including a temperature control switch having a sensor element extending into said combustion chamber to turn said burner off upon a rise in temperature of said liquid being used to cool the combustion gases above a predetermined limit.

20. An apparatus according to claim 18 including a temperature control switch having a sensor element extending into said reservoir compartment for controlling the operation of said burner, said blower, and said pump in response to the temperature of said reservoir liquid.

21. An apparatus according to claim 18 including a pressure control switch positioned in a conduit between said pump and said water jacket to control the ignition of said burner and operation of said gas valve.

* * * * *